US007007877B1

(12) United States Patent
Kuhmonen

(10) Patent No.: US 7,007,877 B1
(45) Date of Patent: Mar. 7, 2006

(54) SCREENING APPARATUS

(75) Inventor: Mauri Kuhmonen, Kallinmaentle (FI)

(73) Assignee: MISU PTY Ltd., Wodonga Victoria (AU)

( * ) Notice: Subject to any disclaimer, the term of this patent is extended or adjusted under 35 U.S.C. 154(b) by 0 days.

(21) Appl. No.: 09/623,542

(22) PCT Filed: Mar. 5, 1999

(86) PCT No.: PCT/AU99/00135

§ 371 (c)(1),
(2), (4) Date: Jul. 8, 2002

(87) PCT Pub. No.: WO99/44788

PCT Pub. Date: Sep. 10, 1999

(30) Foreign Application Priority Data

Mar. 5, 1998 (AU) ..... PP2204

(51) Int. Cl.
*B02C 18/16* (2006.01)

(52) U.S. Cl. ..... 241/236

(58) Field of Classification Search ..... 241/236, 241/79

See application file for complete search history.

(56) References Cited

U.S. PATENT DOCUMENTS

| | | | | |
|---|---|---|---|---|
| 45,222 | A * | 11/1864 | Buchanan | 241/144 |
| 2,502,563 | A * | 4/1950 | Goodchild | 366/91 |
| 4,479,581 | A * | 10/1984 | Kelyman, Jr. | 209/3 |
| 4,684,071 | A * | 8/1987 | Dicky | 241/80 |
| 5,405,092 | A | 4/1995 | Jonninen | |
| 5,449,072 | A | 9/1995 | Braun et al. | |
| 5,485,689 | A | 1/1996 | Jonninen | |
| 5,619,811 | A | 4/1997 | Yrjola | |
| 5,887,810 | A | 3/1999 | Maruyama | |
| 6,237,865 | B1 | 5/2001 | Luttermann et al. | |

FOREIGN PATENT DOCUMENTS

| | | |
|---|---|---|
| JP | 09053252 | 2/1997 |
| SE | 7804168 | 4/1980 |
| SU | 1759459 | 9/1992 |
| WO | WO 88/01201 | * 2/1988 |
| WO | 9118152 | 11/1991 |
| WO | 95/11093 | 4/1995 |
| WO | 9511093 | 4/1995 |

* cited by examiner

*Primary Examiner*—Mark Rosenbaum
(74) *Attorney, Agent, or Firm*—Burr & Brown

(57) ABSTRACT

A screening apparatus (10) for screening particulate material includes a frame (12) having an open bottom (14) through which screened particles can pass and a plurality of banks of blades (16A–16E) supported on the frame (12). Each bank of blades (16) is rotatable about respect axes of rotation (18A–18E). The blades (20) of each bank (16) are evenly spaced and arranged in a single row coincident with their respective axes of rotation (18). At least one of the banks of blades (16) is able to slide linearly along its respective axis of rotation (18) to provide a predetermined amount of axial freeplay. When the blades (20) agitate rotated and a particulate material is placed in screen frame (12), the rotating blades (20) agitate and/or crush the material to allow particles of a size equal to or smaller than a gap formed between each of the adjacent blades to fall through the open bottom.

17 Claims, 3 Drawing Sheets

SCREENING APPARATUS

FIELD OF THE INVENTION

This invention is for a screening apparatus particularly suited for screening particulate material, although it may also be used for crushing, mixing or blending particulate material.

BACKGROUND OF THE INVENTION

It is often necessary to screen particulate material in order to sort it in accordance with particle size. For example when mixing concrete or when building roads, it is necessary to screen gravel in order to sort into piles of different mean gravel size. Conventional screening apparatuses use screens and rotating or vibrating beds to select given particle size output. All particles which are of size equal or smaller to the selected size fall through the screen while the particles of larger size are held on the screen for later removal. One notable disadvantage with the rotating or vibrating bed type screening apparatuses is that they have a tendency to become clogged.

SUMMARY OF THE INVENTION

It is an object of the present invention to provide an alternate form of screening apparatus which attempts to alleviate the problems in the above described prior art.

According to the present invention there is provided a screening apparatus for screening a particulate material composed of particles of different size, said apparatus including:

- a screen frame having an open bottom through which screened particles can pass;
- a plurality of banks of blades supported on the screen frame; each bank having a plurality of evenly spaced blades arranged in a row and rotatable about a respective axis, the axes being parallel to each other, with adjacent banks of blades axially offset relative to each other so that the blades of one bank alternate with the blades of an adjacent bank, and wherein at least one bank of blades is linearly slidable along its axis of rotation to provide a predetermined amount of axial freeplay and where a sizing gap is formed between mutually adjacent blades of adjacent banks;
- wherein, when the blades are rotated and a particulate material is placed on the blades, the rotating blades agitate and/or crush the material to allow particles of a size equal to or smaller than the sizing gap to pass between the blades and through the open bottom.

Preferably the blades are juxtaposed so that the blades on one bank extend transversely between the adjacent blades of an adjacent bank.

Preferably said blades are configured and juxtaposed so that if the blades of one bank were directly opposite the blades of an adjacent bank the opposed blade would intermesh.

Preferably said screen frame is in the form of a bottomless scoop or bucket adapted for coupling to an earthmoving vehicle whereby said vehicle can be controlled to manipulate said scoop or bucket to scoop particulate material into said screen frame and/or elevate said screen frame above the ground while said blades are rotated.

Preferably said screening apparatus further includes one or more hydraulic motors for driving said banks of blades, said motors supported on said screen frame and wherein hydraulic fluid for said motors is derived from said earthmoving vehicle.

BRIEF DESCRIPTION OF THE DRAWINGS

An embodiment of the present invention will now be described by way of example only with reference to the accompanying drawings in which.

DETAILED DESCRIPTION OF THE PREFERRED EMBODIMENT

Referring to the accompanying drawings, a screening apparatus 10 for screening a particulate material composed of particles of different size (not shown) includes a screen frame 12 having an open bottom 14 through which screened particles can pass and a plurality of banks of blades 16A–16E (hereinafter referred to generally as "banks of blades 16") supported on the frame 12. In this embodiment, the frame 12 is of a form similar to the bucket or scoop found on an earthmoving vehicle such as a bobcat or front end loader but with a bottom section removed to provide the open bottom 14.

Figure 2:
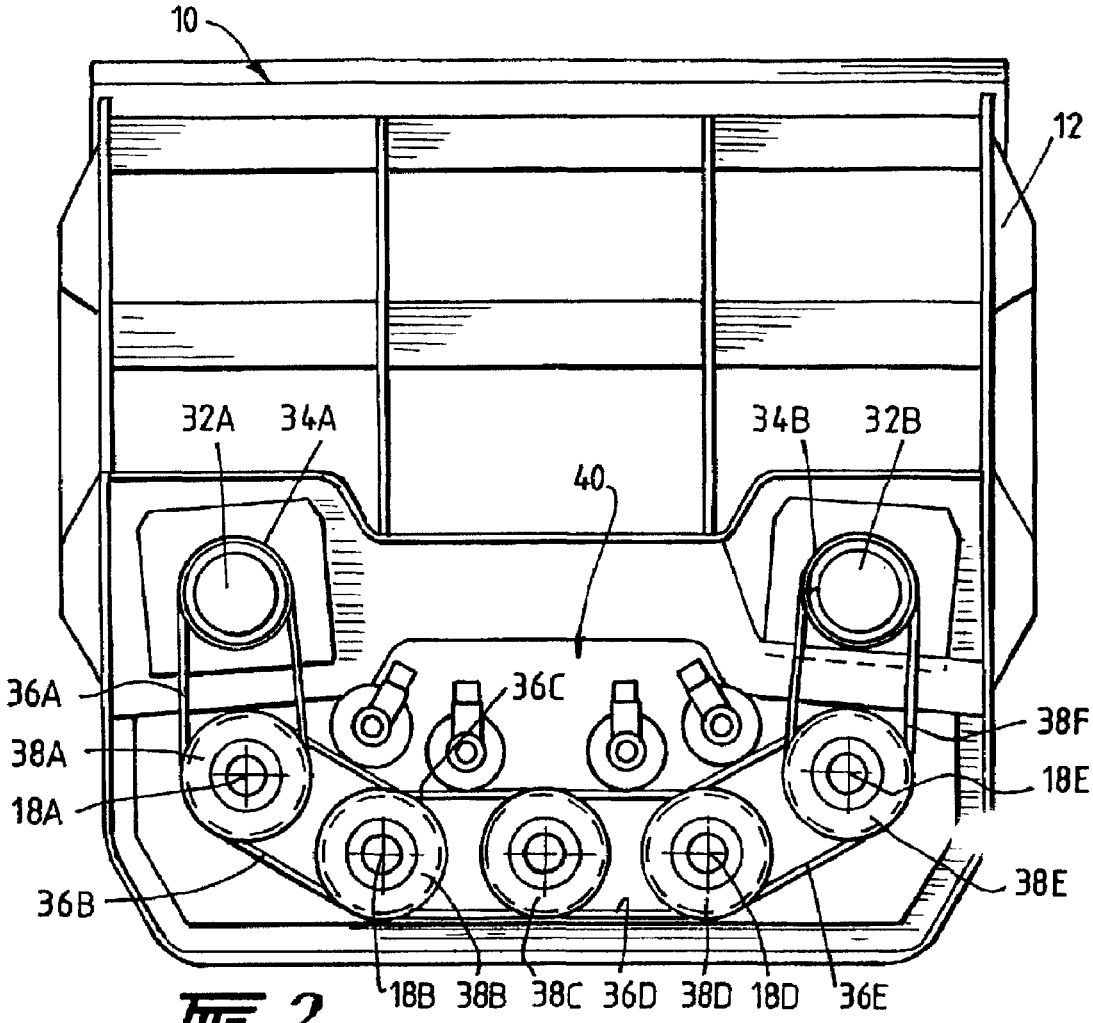
FIG. 2 is a side view of the screening apparatus.

Each bank of blades 16 is rotatable about a respective axis of rotation 18A–18E (referred to hereinafter in general as "axes 18"). The axes 18 run parallel to each other although, as most clearly seen in FIGS. 2 and 4, axes 18A and 18E are located in a higher plane than axes 18B–18D.

Blades 20 of each bank 16 are evenly spaced and arranged in a single row coincident with their respective axes of rotation 18. For ease of description, the blades for the banks 16A–16E are designated as blades 20A–20E respectively. As seen most clearly in FIG. 4, the blades 20A are configured so that if they were directly opposite the blades 20B of an adjacent bank 16, the opposed blades would intermesh. In this embodiment, each blade 20 is generally square in shape and has an arcuate scallop 22 formed midway between adjacent corners in each side of the blade 20. This leaves the blades with diagonally extending fingers 24 which can ride in or pass through the scallop 22 of an adjacent blade 20 during a portion of the rotation of the blade 20.

At least one of the banks of blades 16 and indeed preferably all of the banks of blades 16 are able to slide linearly along their respective axes of rotation 18 to provide a predetermined amount of axial freeplay.

Figure 1:
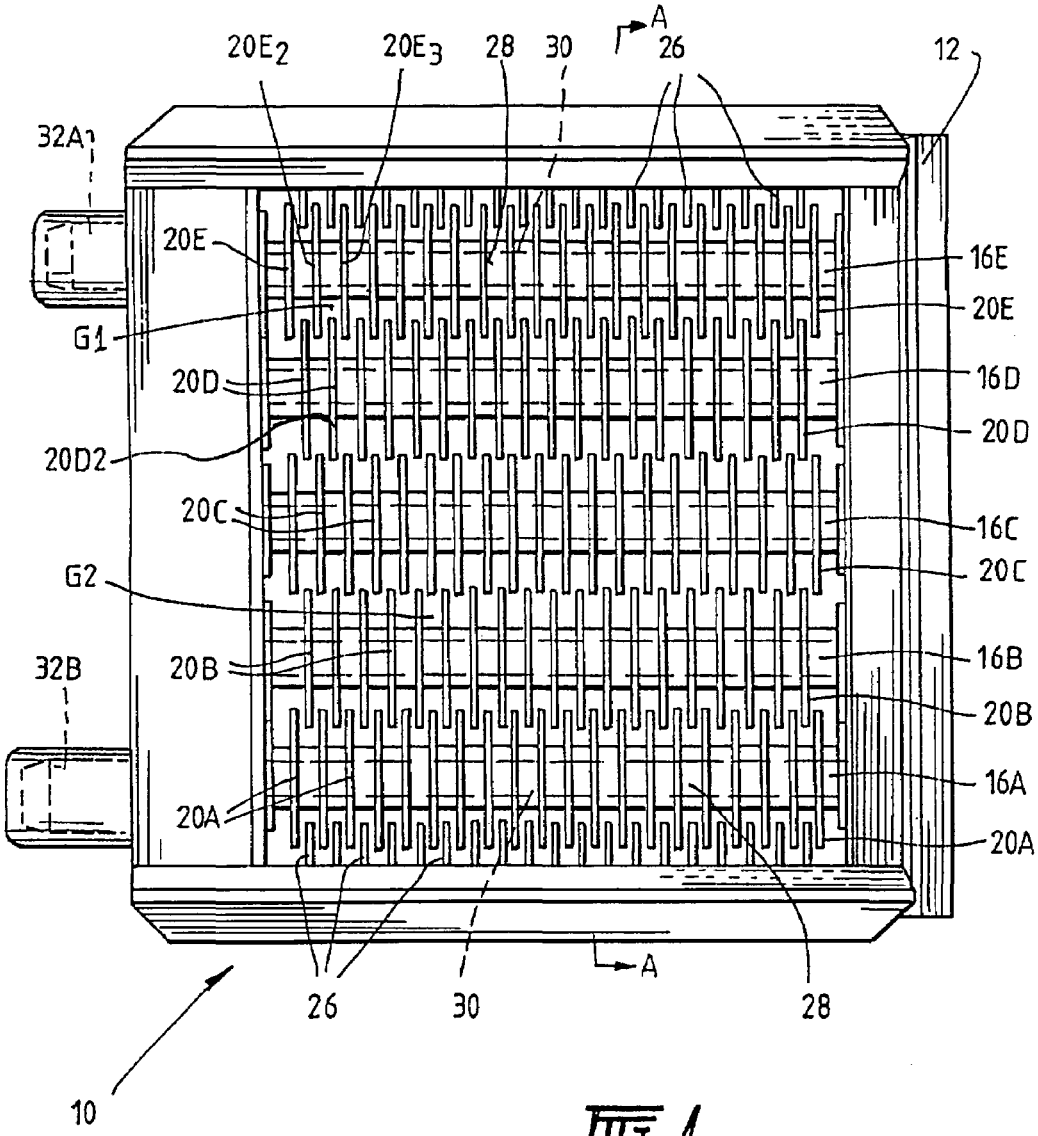
FIG. 1 is a plan view of an embodiment of the screening apparatus in accordance with this invention.

A sizing gap G is formed between a blade 20 of one bank 16 and adjacent blades 20 on an adjacent bank 16. With reference to FIG. 1, a sizing gap G is formed between the blade 20D2 of bank 16D and blades 20E2 and 20E3 of bank 16B. The sizing gap determines the size of particles that can pass through the apparatus 10. As is apparent from FIG. 1, the sizing gap G, may be different between different adjacent pairs of banks 16, (compare gaps G1 with gap G2).

When in use, drive is provided to the banks 16 causing them to rotate and a pile of particulate material is placed on the blades 20. The rotating blades agitate and/or crush the particulate material to allow particles of a size equal to or smaller than the sizing gap to pass between the blades 20 through the open bottom 14. It will be appreciated that as the blades 20 rotate they may also act to crush or break particles to a size so as to fit through the sizing gap.

As is apparent from FIG. 1, the blades 20 of adjacent banks 16 are staggered so that the blades of one bank alternate with the blades of an adjacent bank looking in the axial direction. Thus, referring to FIG. 1, the blades 20A of bank 16A alternate with the blades 20B of bank 16B. Also the blades 20 of at least some of the banks 16 overlap each other, see for example blades 20A which overlap with (ie extend transversely between) adjacent blades 20B. However, the degree of overlap is not necessarily uniform between adjacent banks. For example in this embodiment, between banks 16B, 16C and 16D the degree of overlap of adjacent blades on adjacent banks is less than the overlap between banks 16A and 16B; and, banks 16D and 16E.

Figure 4:
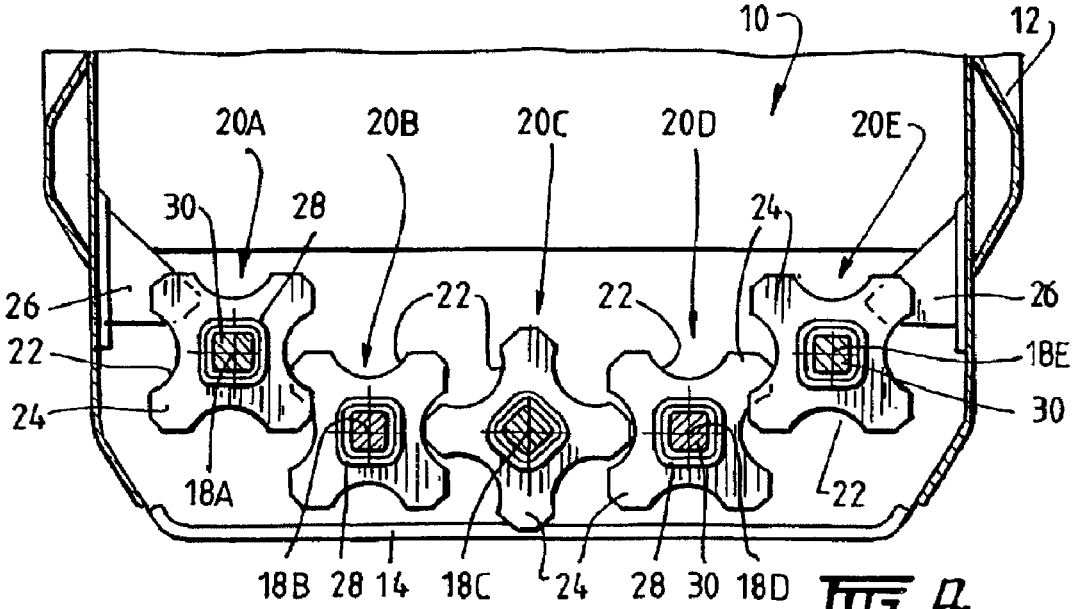
FIG. 4 is a view along section AA of the screening apparatus shown in FIG. 1.
Figure 3:
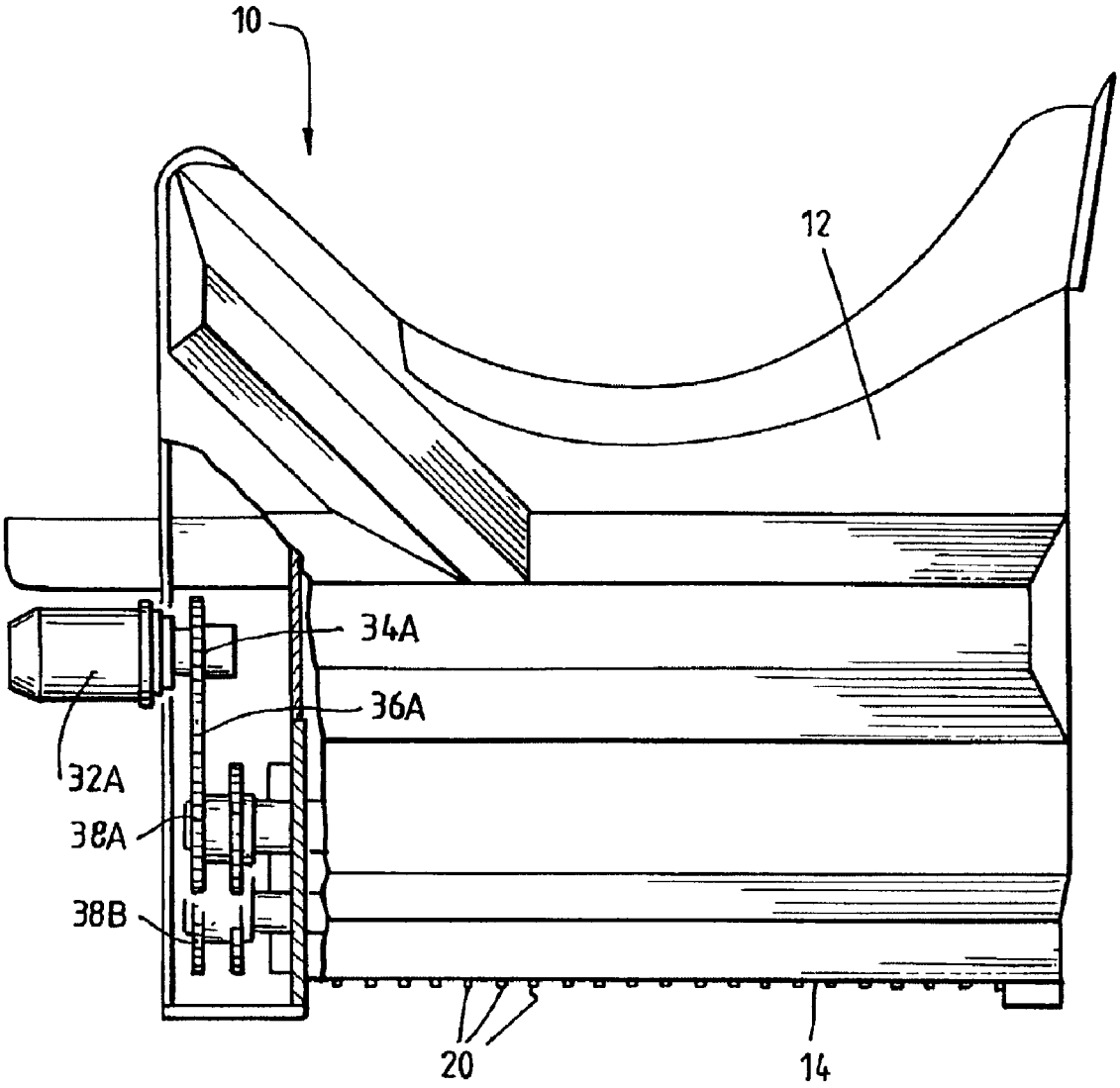
FIG. 3 is a rear view of the screening apparatus.

As shown in FIG. 4, a row of plates 26 is provided along the inside on each side of the frame 12. Each plate 26 is disposed between adjacent blades 20A/20E on banks 16A/16E respectively. The plates 26 effectively act to block gaps between the banks 16A and 16E and the adjacent sides of the frame 12.

The axial freeplay of the banks 16 is provided by forming the blades 20 on respective sleeves 28 which in turn are slidably mounted on respective rotatable axles 30. In order to allow for a transfer of torque between the axle 30 and its respective sleeve 28, both are formed with a non circular (in this instance square) cross section. Although, in alternate embodiments, these sections can be circular and keys or other arrangements provided in order to allow the transfer of torque from the axle 30 to its sleeve 28. The degree of axial freeplay of each sleeve 28 is limited by conventional means such as of stops and flanges. The freeplay can be limited to ensure that a bank 16 cannot slide axially more than one half the distance between adjacent blades 20.

Drive is imparted to the bank 16 via hydraulic motors 32A and 32B which are attached to the frame 12. The hydraulic motors 32A, 32B may receive hydraulic fluid from a further hydraulic motor which typically would be part of an earth-moving vehicle to which the apparatus 10 is connected. The hydraulic motors 32A, 32B have respective pulley wheels 34A, 34B to allow a transfer of torque to the banks 16. The axle 30 for each bank of blades 16 is also provided with a respective pulley wheel 38A–38E. A pulley chain or belt 36A couples pulley wheels 34A and 38A; chain/belt 36B couples pulley wheels 38A and 38B; chain/belt 36C couples pulley 38B and 38C; chain/belt 36D couples pulley 38C and 38D; chain/belt 36E couples pulley 38D and 38E; and chain/belt 36F couples pulley wheels 38E and 34B. By virtue of this arrangement, each of the pulley wheels 38 and thus each of the banks of blades 16 are rotated in the same direction. A series of idler rollers 40 is provided for applying tension to the chain/belts 36B, 36C, 36D and 36E.

When the frame 12 of apparatus 10 is connected to say a bobcat or front end loader, the bobcat or front end loader can be used manipulate the frame 12 to scoop up a supply of particulate material which is supported on the blades 20, and if desired elevate the frame 12 above the ground so that a pile of screened material can be formed below. Then the hydraulic motor 32 are activated to cause rotation of the blades 20. As the blades rotate they agitate the particulate material and allow particles of a size smaller than the sizing gap G to pass between the banks of blades 16 and through the open bottom 14. The blades 20 may also act to crush or break the particulate material down to a size which will pass through the sizing gap. Material which is of a size larger than the sizing gap and is not crushed or otherwise broken (hereinafter referred to as "oversized particles") remain on top of the blades 20. Eventually, the amount of oversized particles supported on the blades 20 reaches a stage where it prohibits the efficient screening of any further particulate material. At this time, the oversized material is simply dumped from the frame 12 at a suitable location.

The freeplay in the banks of blades 16 which allows axial movement has been found to assist in preventing clogging of the apparatus 10.

Now that an embodiment of the apparatus 10 has been described in detail it will be apparent to those skilled in the relevant arts that numerous modifications and variations may be made without departing from the basic inventive concepts. For example, the present embodiment illustrates the use of five banks 16 of blades. However, the number of banks can be varied to suit the application at band. Also, the outer most banks 16A and 16E are shown as being raised above the remaining banks to form a cradle like structure or shape of banks 16. However this is not necessary; in other configurations all the banks 16 can be in the same plane, or arranged in an alternating "up and down" configuration. Further, the degree of freeplay in the banks 16 can be made adjustable to allow adjustment of the freeplay for different applications. This can be provided for by simple known mechanical devices such as threaded collars, lock nuts and shims etc which can be moved axially along the axle 30 and then locked in place. Also, while the frame 12 in this embodiment is in the form of a bucket or scoop from a bobcat or front end loader, it can take any other suitable form such as a simple rectangular or square box like structure having an open top and an open bottom. Any type of particulate material can be screened, crushed, mixed or blended with this apparatus such as for example gravel, sand, soil, aggregates, humus etc. Also, while the banks 16 are described as being rotated in the same direction, they can be arranged to rotate in different directions by use of conventional gearing. All such modifications and variations together with others which would be obvious to a person of ordinary skill in the art are deemed to be within the scope of the present invention the nature of which is to be determined from the aforegoing description and the appended claims.

What is claimed is:

1. A screening apparatus for screening a particulate material composed of particles of different size, said apparatus including:

a screen frame having an open bottom through which screened particles can pass;

a plurality of banks of blades supported on the screen frame; each bank having a plurality of evenly spaced blades arranged in a row and rotatable about a respective axis, the axes being parallel to each other, with adjacent banks of blades axially offset relative to each other so that the blades of one bank alternate with the blades of an adjacent bank, and wherein at least one bank of blades is linearly slidable along its axis of rotation to provide a predetermined amount of axial freeplay and where sizing gaps are formed between mutually adjacent blades of adjacent banks;

wherein, when the blades are rotated and a particulate material is placed on the blades, the rotating blades agitate and/or crush the material to allow particles of a size equal to or smaller than an adjacent sizing gap to pass between the blades and through the open bottom.

2. A screening apparatus according to claim 1 wherein the blades are juxtaposed so that the blades on one bank extend transversely between the adjacent blades of an adjacent bank.

3. A screening apparatus according to claim 2 wherein said blades are configured and juxtaposed so that if the blades of one bank were directly opposite the blades of an adjacent bank the opposed blades would intermesh.

4. A screening apparatus according to claim 3 wherein said screen frame is in the form of a bottomless scoop or bucket adapted for coupling to an earthmoving vehicle whereby said vehicle can be controlled to manipulate said scoop or bucket to scoop particulate material into said screen frame and/or elevate said screen frame above the ground while said blades are rotated.

5. A screening apparatus according to claim 4 further including one or more hydraulic motors for driving said banks of blades, said motors being supported on said screen frame and wherein hydraulic fluid for said motors is derived from said earthmoving vehicle.

6. A screening apparatus according to claim 1, further comprising first and second sets of plates, said first set of plates being positioned between a first side of said frame and a first bank of blades adjacent said first side of said frame, each plate in said first set of plates being disposed between adjacent blades on said first bank of blades, said second set of plates being positioned between a second side of said frame and a second bank of blades adjacent said second side of said frame, each plate in said second set of plates being disposed between adjacent blades on said second bank of blades.

7. A screening apparatus for screening a particulate material composed of particles of different size, said apparatus comprising:

a screen frame having an open bottom through which screened particles can pass;

a plurality of banks of blades supported on the screen frame; each bank having a plurality of evenly spaced blades arranged in a row and rotatable about a respective axis, the axes being parallel to each other, and the blades in every row lying in respective planes that are perpendicular to the axes, with adjacent banks of blades axially offset relative to each other so that the blades of one bank alternate with the blades of an adjacent bank, and wherein at least one bank of blades is linearly slidable along its axis of rotation to provide a predetermined amount of axial freeplay and where a sizing gap is formed between mutually adjacent blades of adjacent banks;

wherein, when the blades are rotated and a particulate material is placed on the blades, the rotating blades agitate and/or crush the material to allow particles of a size equal to or smaller than the sizing gap to pass between the blades and through the open bottom.

8. The screening apparatus according to claim 7 wherein the blades are juxtaposed so that the blades on one bank extend transversely between the adjacent blades of an adjacent bank.

9. The screening apparatus according to claim 8 wherein said blades are configured and juxtaposed so that if the blades of one bank were directly opposite the blades of an adjacent bank the opposed blades would intermesh.

10. The screening apparatus according to claim 9 wherein said screen frame is in the form of a bottomless scoop or bucket adapted for coupling to an earthmoving vehicle whereby said vehicle can be controlled to manipulate said scoop or bucket to scoop particulate material into said screen frame and/or elevate said screen frame above the ground while said blades are rotated.

11. The screening apparatus according to claim 10 further comprising one or more hydraulic motors for driving said banks of blades, said motors being supported on said screen frame and wherein hydraulic fluid for said motors is derived from said earthmoving vehicle.

12. A screening apparatus for screening a particulate material composed of particles of different size, said apparatus comprising:

a screen frame having an open bottom through which screened particles can pass;

a plurality of banks of blades supported on the screen frame; each bank having a plurality of evenly spaced blades arranged in a row and rotatable about a respective axis, the axes being parallel to each other, with adjacent banks of blades axially offset relative to each other so that the blades of one bank alternate with the blades of an adjacent bank, and wherein at least one bank of blades comprises a sleeve mounted on an axle having a longitudinal axis coincident with the axis of rotation of a corresponding bank of blades, the sleeve rotationally fixed to the axle and slideable linearly along the axle to provide a predetermined amount of axial freeplay and where a sizing gap is formed between mutually adjacent blades of adjacent banks;

wherein when the blades are rotated and a particulate material is placed on the blades, the rotating blades agitate and/or crush the material to allow particles of a size equal to or smaller than the sizing gap to pass between the blades and through the open bottom.

13. The screening apparatus according to claim 12 wherein the blades in each row lie in respective planes that are perpendicular to the axes.

14. The screening apparatus according to claim 13 wherein the blades are juxtaposed so that the blades on one bank extend transversely between the adjacent blades of an adjacent bank.

15. The screening apparatus according to claim 14 wherein said blades are configured and juxtaposed so that if the blades of one bank were directly opposite the blades of an adjacent bank the opposed blades would intermesh.

16. The screening apparatus according to claim 15 wherein said screen fame is in the form of a bottomless scoop or bucket adapted for coupling to an earthmoving vehicle whereby said vehicle can be controlled to manipulate said scoop or bucket to scoop particulate material into said screen frame and/or elevate said screen frame above the ground while said blades are rotated.

17. The screening apparatus according to claim 16 further comprising one or more hydraulic motors for driving said banks of blades, said motors being supported on said screen fame and wherein hydraulic fluid for said motors is derived from said earthmoving vehicle.

* * * * *

UNITED STATES PATENT AND TRADEMARK OFFICE

CERTIFICATE OF CORRECTION

PATENT NO. : 7,007,877 B1
APPLICATION NO. : 09/623542
DATED : March 7, 2006
INVENTOR(S) : Mauri Kuhmonen It is certified that error appears in the above-identified patent and that said Letters Patent is hereby corrected as shown below:

Title page,
Item [75], Inventor, change "Kallinmaentle" to -- Kallinmaentie --.

Column 3,
Line 59, change "motor" to -- motors --.

Column 6,
Lines 47 and 56, change "fame" to -- frame --.

Signed and Sealed this

Twentieth Day of June, 2006

JON W. DUDAS
*Director of the United States Patent and Trademark Office*